US005737913A

United States Patent [19]

Terry

[11] Patent Number: 5,737,913

[45] Date of Patent: Apr. 14, 1998

[54] SELF-ALIGNING QUICK RELEASE ENGINE CASE ASSEMBLY

[75] Inventor: James L. Terry, Huber Heights, Ohio

[73] Assignee: The United States of America as represented by the Secretary of the Air Force, Washington, D.C.

[21] Appl. No.: 739,351

[22] Filed: Oct. 18, 1996

[51] Int. Cl.[6] ..... F02C 7/20

[52] U.S. Cl. ..... 60/39.31; 415/214.1; 403/348; 285/360

[58] Field of Search ..... 60/39.31; 415/214.1; 403/337, 338, 348; 285/360, 401, 402

[56] References Cited

U.S. PATENT DOCUMENTS 2,839,894 6/1958 Shutts et al. ..... 60/39.31
4,361,296 11/1982 Hall et al. ..... 60/39.31
4,411,134 10/1983 Moir ..... 60/39.31
5,088,775 2/1992 Corsmeier et al. ..... 403/338
5,145,276 9/1992 Demange ..... 285/360

*Primary Examiner*—Charles G. Freay
*Attorney, Agent, or Firm*—Bobby D. Scearce; Thomas L. Kundert

[57] ABSTRACT

An engine casing structure for a gas turbine engine or the like is described which comprises two substantially tubular shaped axially adjacent abutting casing portions and a rotatable clamping ring on one casing portion having a plurality of lugs which engage a corresponding plurality of lugs on the axially adjacent casing portion providing a positive clamping force between the two casing portions, the clamping ring being held in place by a small plurality (eight or fewer) of bolts.

4 Claims, 2 Drawing Sheets

SELF-ALIGNING QUICK RELEASE ENGINE CASE ASSEMBLY

RIGHTS OF THE GOVERNMENT

The invention described herein may be manufactured and used by or for the Government of the United States for all governmental purposes without the payment of any royalty.

BACKGROUND OF THE INVENTION

The present invention relates generally to engine casing structures for gas turbine engines and the like, and more particularly to a self-aligning quick release engine casing structure which simplifies the assembly process and facilitiates disassembly for engine maintenance and repair.

Engine casing structures in conventional gas turbine aircraft engines typically consist of a flanged casing assembly held together by a large plurality of bolts, nuts and washers. As many as 200 attachment bolts may connect the combustor and turbine sections or 120 bolts may connect the compressor and combustor. Engine assembly requires careful alignment of the casing portions and controlled torquing of each assembly bolt to specification and, upon disassembly of the engine for maintenance or repair, each assembly bolt should be replaced in order to maintain structural integrity of the re-assembled engine housing. In addition, the engine housing may be configured in sections so that a portion of the housing may be removed in order to access internal components such as the compressor fan and blades. Such a structure necessarily includes additional assembly flanges and bolts, introduces additional alignment problems and may, during engine operation, subject the housing to thermal stresses affecting structural integrity. Disassembly of the engine for maintenance and repair is therefore an expensive, labor intensive and time consuming procedure, and conventional engines are therefore typically removed from the aircraft and returned to the manufacturer or to a maintenance facility for maintenance or overhaul.

The invention solves or substantially reduces in critical importance problems with conventional turbine engine structures as just described by providing a self-aligning, quick release engine casing assembly wherein a slip ring on one casing portion engages lugs on the adjoining casing portion and provides a positive assembly clamping force, the two casing portions being secured by two to eight bolts depending on casing diameter. An engine casing configured according to the invention is characterized by reduced manufacturing costs, facilitated disassembly and re-assembly for repair or maintenance and substantially reduced number of assembly fasteners.

It is a principal object of the invention to provide an improved engine casing attachment structure.

It is another object of the invention to provide a self-aligning casing structure for rotating engine component clearances in a gas turbine engine or the like.

It is another object of the invention to provide a quick release housing structure connecting axially adjacent sections of a gas turbine engine, including the fan, compressor, combustor, turbine, augmentor or nozzle.

It is a further object of the invention to provide an engine casing structure for a gas turbine engine of simplified configuration facilitating engine manufacture, maintenance, repair or overhaul.

These and other objects of the invention will become apparent as a detailed description of representative embodiments proceeds.

SUMMARY OF THE INVENTION

In accordance with the foregoing principles and objects of the invention, an engine casing structure for a gas turbine engine or the like is described which comprises two substantially tubular shaped axially adjacent abutting casing portions and a rotatable clamping ring on one casing portion having a plurality of lugs which engage a corresponding plurality of lugs on the axially adjacent casing portion providing a positive clamping force between the two casing portions, the clamping ring being held in place by a small plurality (eight or fewer) of bolts.

DESCRIPTION OF THE DRAWINGS

The invention will be more clearly understood from the following detailed description of representative embodiments thereof read in conjunction with the accompanying drawings wherein.

DETAILED DESCRIPTION

Figure 1:
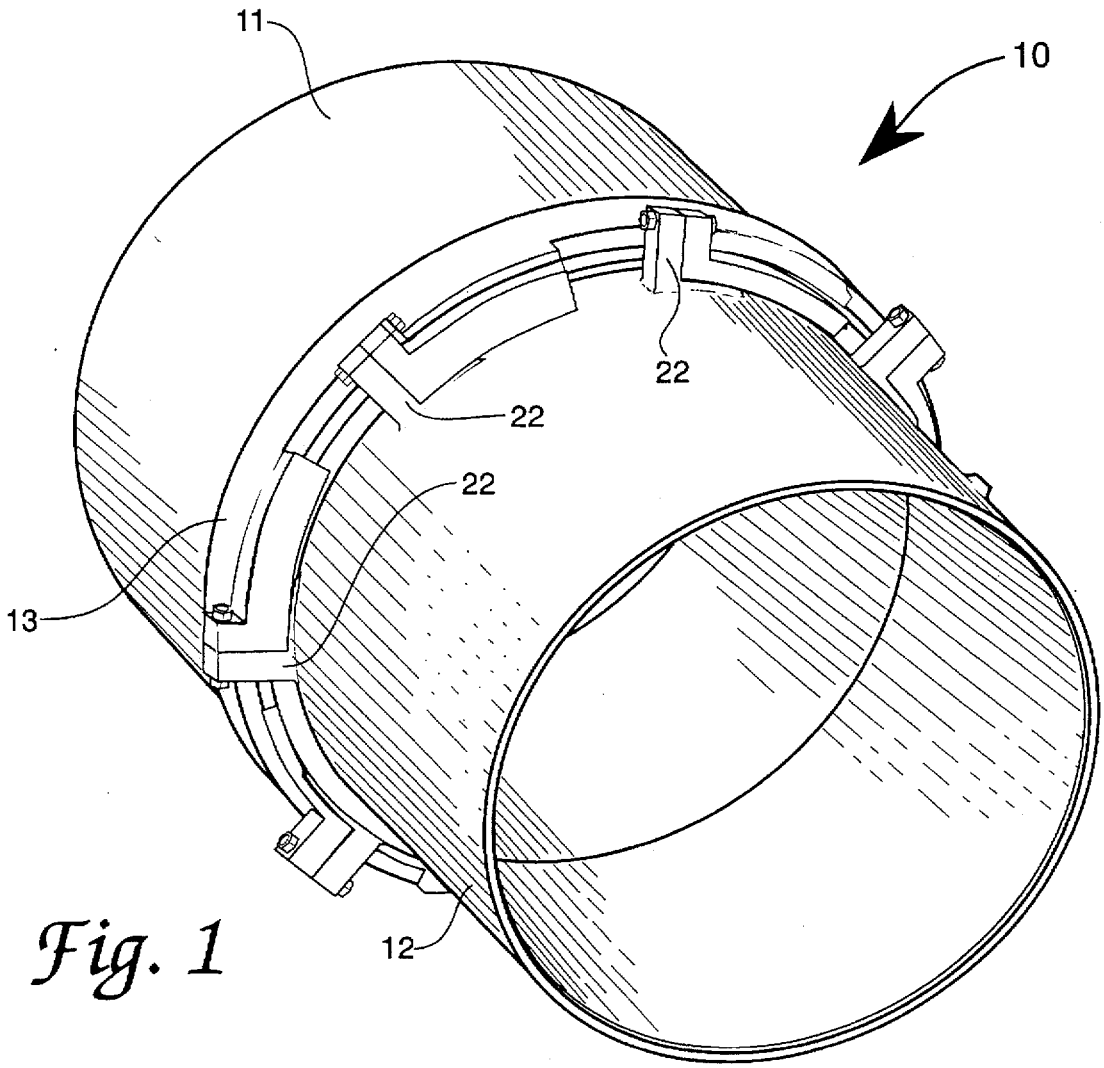
FIG. 1 is a perspective view of a representative turbine engine casing structure according to the invention.
Figure 2:
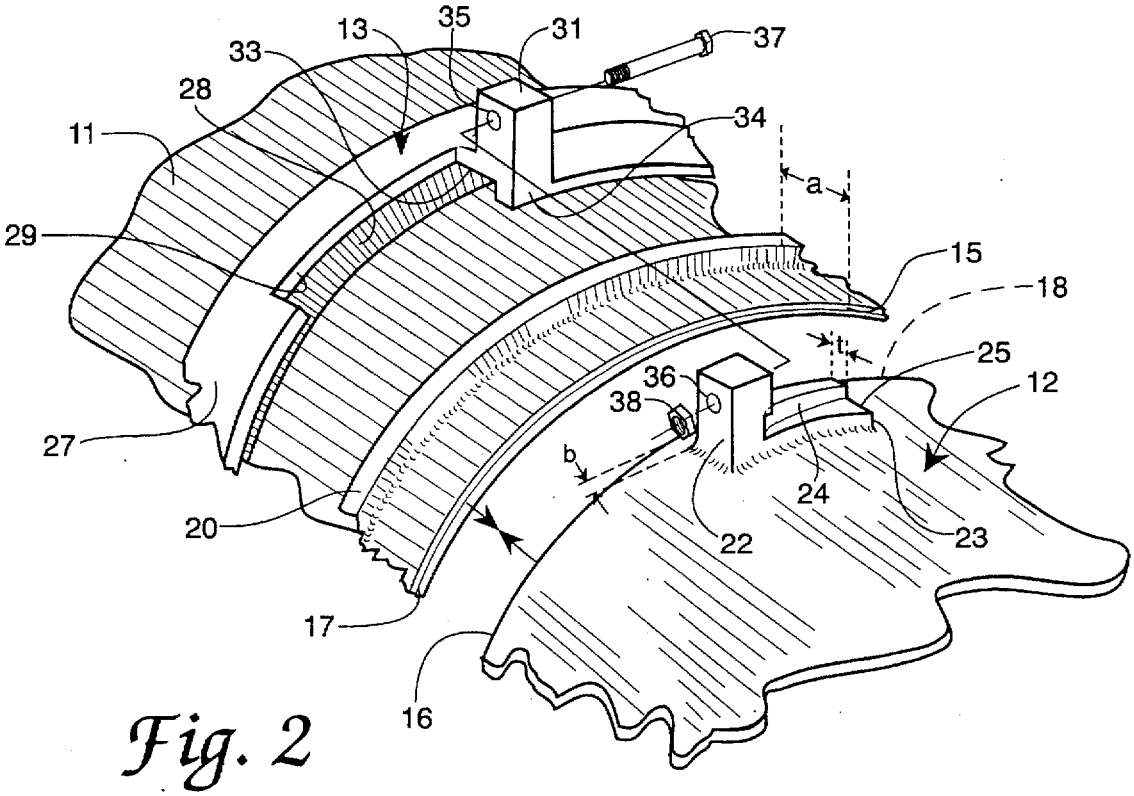
FIG. 2 is an enlarged exploded partial view of the lug and slip ring of the FIG. 1 structure.

Referring now to the drawings, FIG. 1 shows a perspective view of a representative turbine engine casing structure 10 according to the invention. FIG. 2 shows an enlarged exploded partial view of structure 10 showing individual assembly components of the FIG. 1 structure. Structure 10 includes three major components and comprises two substantially tubular shaped casing portions 11, and 12 and a clamping ring 13 which are assembled as suggested in FIGS. 1 and 2. Casing portions 11, 12 are preferably configured at their respective abutting ends 15,16 with mating annular steps 17,18 in order to facilitate axial alignment of portions 11,12 upon assembly. Casing portion 11 has on the outer surface thereof an annular flange 20. Casing portion 12 has attached to the outer surface thereof (as by welding, brazing or the like) one or more pairs of diametrically oppositely disposed lugs 22 having an extension in the form of a flanged annular segment 23 on which the flanged portion 24 includes a thickness t which tapers slightly from lug 22 toward the distal end 25 of segment 23. Annular flange 20 is spaced a distance a from abutting end 15 of casing portion 11 and lugs 22 are spaced a distance b from abutting end 16 of casing portion 12, as suggested in FIG. 2, corresponding to the size of clamping ring 13 as described fully in detail below.

Clamping ring 13 has the shape of an annular flange having axially extending portion 27 and radially extending portion 28, portion 27 being sized in inner diameter to slip over annular flange 20 and portion 27 being sized in inner diameter to snugly receive the outer diameter of casing portion 11. Clamping ring 13 may be fabricated by machining, forging or other process as would occur to the skilled artisan guided by these teachings, and has one or more pairs of diametrically oppositely disposed notches 29 defined in portion 27 thereof, corresponding in number to the number of lugs 22 on casing portion 12 and sized in length to slideably receive lugs 22 and annular segment 23. A lug 31 is attached to (as by welding, brazing or the like) or integral with (as by machining) clamping ring 13 at the outer surface of portion 27 adjacent each notch 29 as suggested in FIG. 2. Each lug 31 is sized and configured to abut and align with a corresponding lug 22 in the assembled FIG. 1 structure. Lugs 22,31 each have bolt holes 35,36 which align in the assembled condition to receive assembly bolt 37 and nut 38. Channel 33 is defined on the inner surface of portion 27 beneath lug 31 between machined flange 34 and radially extending portion 28, channel 33 being sized to snugly receive annular segment 23 of lug 22 in the assembled condition. Portion 27 of clamping ring 13 has axial length such that in the assembled condition, radially extending portion 28 of clamping ring 15 abuts annular flange 20.

Structure 10 may be assembled by first sliding clamping ring 15 over casing portion 11 as suggested in FIG. 2. Casing portion 12 at end 16 is then positioned in abutting relationship against casing portion 11 at end 15 thereof. Clamping ring 15 is then slipped over flange 20 in a position so that each notch 29 on ring 13 receives a corresponding lug 22 and annular segment 23 on casing portion 12. Clamping ring 13 is then rotated into a locking position whereby annular segment 23 engages channel 33 and the taper on flange 24 engages the inner surface of machined flange 34 and lugs 22,31 are in near abutting relationship. As assembly bolts and nuts 37,38 are tightened, the two casing portions 11,12 are firmly clamped together by reason of the abutting relationship of radially extending portion 28 against flange 20 and the force exerted by the taper on flange 34.

It is noted that the number of lug 22,31 pairs and corresponding assembly bolts which are required for a given casing structure 10 depends on the diameter of the casings 11,12. Only one pair of lugs 22,31 and assembly bolts may be needed for a casing diameter of about four inches, and only about four pairs (i.e., 8 lugs 22, 8 lugs 31 and 8 bolts) are needed for casing sizes of about 14 to 16 inches, with two or three pairs accommodating the intermediate sizes. It is noted further that the only critical dimensions to be held in the manufacturing and assembly of the structure of the invention are on the mating diameters of casing portions 11,12 at annular steps 17,18 and the ring 13 clamping distance defined as a+b. The taper on annular extension 23 of lug 22 is sufficient such that when structure 10 is assembled and bolts 37 are tightened, casing portions 11,12 abut each other with substantially the same tension as a conventional casing assembly having a multiplicity of torqued bolts, and presents about the same contacting area as with the conventional assembly.

Casing portions 11,12 and clamping ring 13 may comprise any suitable metallic material conventionally used for engine housing structures, such as titanium and nickel alloys or other high temperature resistant metal or alloy, as would occur to the skilled artisan guided by these teachings, specific material selection not being considered limiting of the invention as defined in the appended claims. It is noted, however, that problems associated with thermal expansion may be obviated by constructing casing portions 11,12 and clamping ring 13 of the same material.

The invention therefore provides a self-aligning case structure for a gas turbine engine or the like. It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

I claim:

1. An engine casing structure for connecting axially adjacent sections of a gas turbine engine, comprising:

(a) first and second substantially tubular shaped casing portions joinable axially in abutting relationship at respective abutting ends thereof in an assembled condition of said structure;

(b) an annular flange on the outer surface of said first casing portion, said annular flange spaced a predetermined distance from the abutting end of said first casing portion;

(c) at least one pair of diametrically oppositely disposed first lugs on the outer surface of said second casing portion and spaced a predetermined distance from the abutting end of said second casing portion, each of said first lugs having a circumferential extension in the form of a flanged annular segment which tapers in axial thickness toward the distal end of said segment;

(d) a clamping ring in the shape of an annular flange having an axially extending portion and a radially extending portion, said axially extending portion being sized in inner diameter to snugly receive said annular flange, and said radially extending portion being sized in inner diameter to snugly receive the outer diameter of said first casing portion, said axially extending portion having defined thereon a plurality of diametrically oppositely disposed notches corresponding in number to the number of said first lugs and sized in circumferential length to slideably receive respective said first lugs and said annular segments thereon;

(e) a second lug disposed on the outer surface of said axially extending portion of said clamping ring adjacent each said notch, each said second lug being sized and configured to abut a corresponding said first lug with said first and second casing portions in said assembled condition, each said first and second lugs having means defining bolt holes therethrough for receiving assembly bolts; and (f) a channel defined on the inner surface of said axially extending portion of said clamping ring beneath each said second lug, each said channel being sized to snugly receive a said annular segment of a said first lug in said assembled condition.

2. The engine casing structure of claim 1 wherein each of said first and second substantially tubular shaped casing portions include respective mating machined steps at the respective abutting ends thereof for facilitating axial alignment of said first and second casing portions upon assembly into said assembled condition.

3. The engine casing structure of claim 1 wherein said first and second casing portions and said clamping ring comprise a high temperature resistant metallic material selected from the group consisting of titanium alloys and nickel alloys.

4. The engine casing structure of claim 3 wherein said first and second casing portions and said clamping ring comprise the same high temperature resistant metallic material.

* * * * *